US007834297B1

(12) United States Patent
Kendall

(10) Patent No.: US 7,834,297 B1
(45) Date of Patent: Nov. 16, 2010

(54) GOLF CLUB GRIP WARNING AND DYING APPARATUS AND METHOD

(76) Inventor: David K. Kendall, 54 Headland Rise, Barrow-In-Furness (GB) LA143YP ( * ) Notice: Subject to any disclaimer, the term of this patent is extended or adjusted under 35 U.S.C. 154(b) by 0 days.

(21) Appl. No.: 12/027,478

(22) Filed: Feb. 7, 2008

(51) Int. Cl.

| | |
|---|---|
| ***F26B 19/00*** | (2006.01) |
| ***F26B 25/08*** | (2006.01) |
| ***A63B 55/00*** | (2006.01) |
| ***F27D 1/00*** | (2006.01) |
| ***F27D 11/02*** | (2006.01) |

(52) U.S. Cl. ..... 219/386; 206/315.2; 206/315.3; 34/107; 34/202

(58) Field of Classification Search ..... None
See application file for complete search history.

(56) References Cited

U.S. PATENT DOCUMENTS

| | | | | |
|---|---|---|---|---|
| 3,686,774 | A * | 8/1972 | Beadle, Jr. | 34/227 |
| 3,707,279 | A | 12/1972 | Kaiser | |
| 4,140,893 | A * | 2/1979 | Renteria | 219/385 |
| 4,570,358 | A * | 2/1986 | Sacerdote | 34/569 |
| 4,644,136 | A * | 2/1987 | Watchman | 219/400 |
| 4,914,832 | A * | 4/1990 | Cuthbert | 34/354 |
| 5,341,927 | A | 8/1994 | Coyner | |
| D370,706 | S | 6/1996 | Mulvey | |
| 5,834,738 | A | 11/1998 | Wilson | |
| 5,983,518 | A | 11/1999 | Ellenburg | |
| 6,756,573 | B2 | 6/2004 | Cornell | |
| 2003/0170013 | A1 * | 9/2003 | Patshkowski et al. | 392/379 |
| 2007/0094884 | A1 * | 5/2007 | Micheludis | 34/107 |

FOREIGN PATENT DOCUMENTS

JP 04132574 A * 5/1992

* cited by examiner

*Primary Examiner*—Joseph M Pelham

(57) ABSTRACT

A golf club grip warning and drying apparatus includes a housing that has a bottom wall and a peripheral wall which is attached to and extending upwardly from the bottom wall. The peripheral wall has an upper edge defines an access opening extending into the housing. A heating assembly is positioned in the housing. The heating assembly provides warm air for an interior of the housing when the heating assembly is turned on. A securing assembly is attached to the housing. The securing assembly is configured to releasably secure the housing to the golf bag. A golf club grip is removably extendable into the housing and heated by the heating assembly.

8 Claims, 7 Drawing Sheets

GOLF CLUB GRIP WARNING AND DYING APPARATUS AND METHOD

BACKGROUND OF THE INVENTION

Field of the Invention

The present invention relates to golf club warming devices and more particularly pertains to a new golf club warming device for heating and drying a golf club grip.

SUMMARY OF THE INVENTION

The present invention meets the needs presented above by generally comprising a housing that has a bottom wall and a peripheral wall which is attached to and extending upwardly from the bottom wall. The peripheral wall has an upper edge defines an access opening extending into the housing. A heating assembly is positioned in the housing. The heating assembly provides warm air for an interior of the housing when the heating assembly is turned on. A securing assembly is attached to the housing. The securing assembly is configured to releasably secure the housing to the golf bag. A golf club grip is removably extendable into the housing and heated by the heating assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
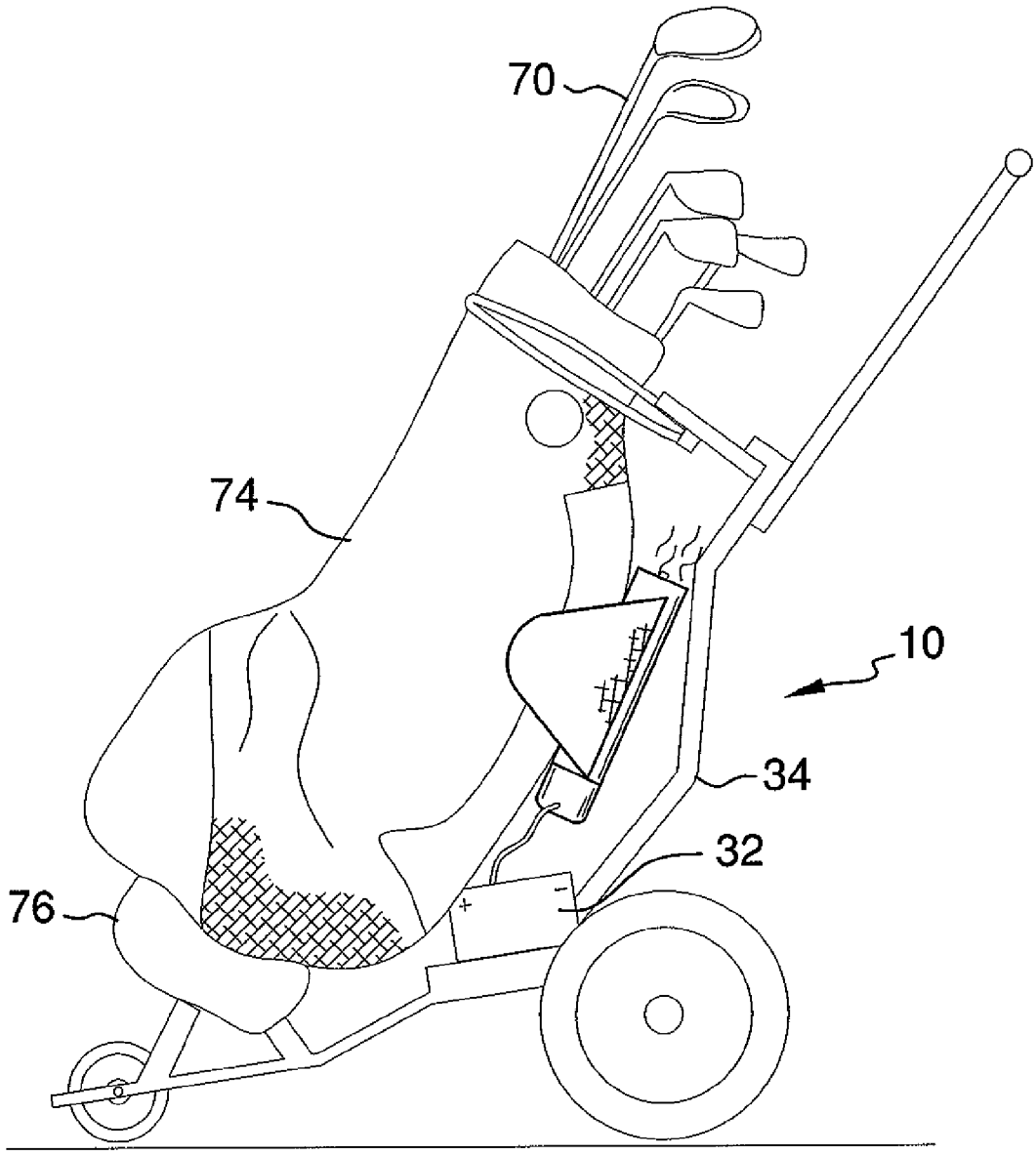
FIG. 1 is a side in-use view of a golf club grip warning and drying apparatus and method according to the present invention.
Figure 2:
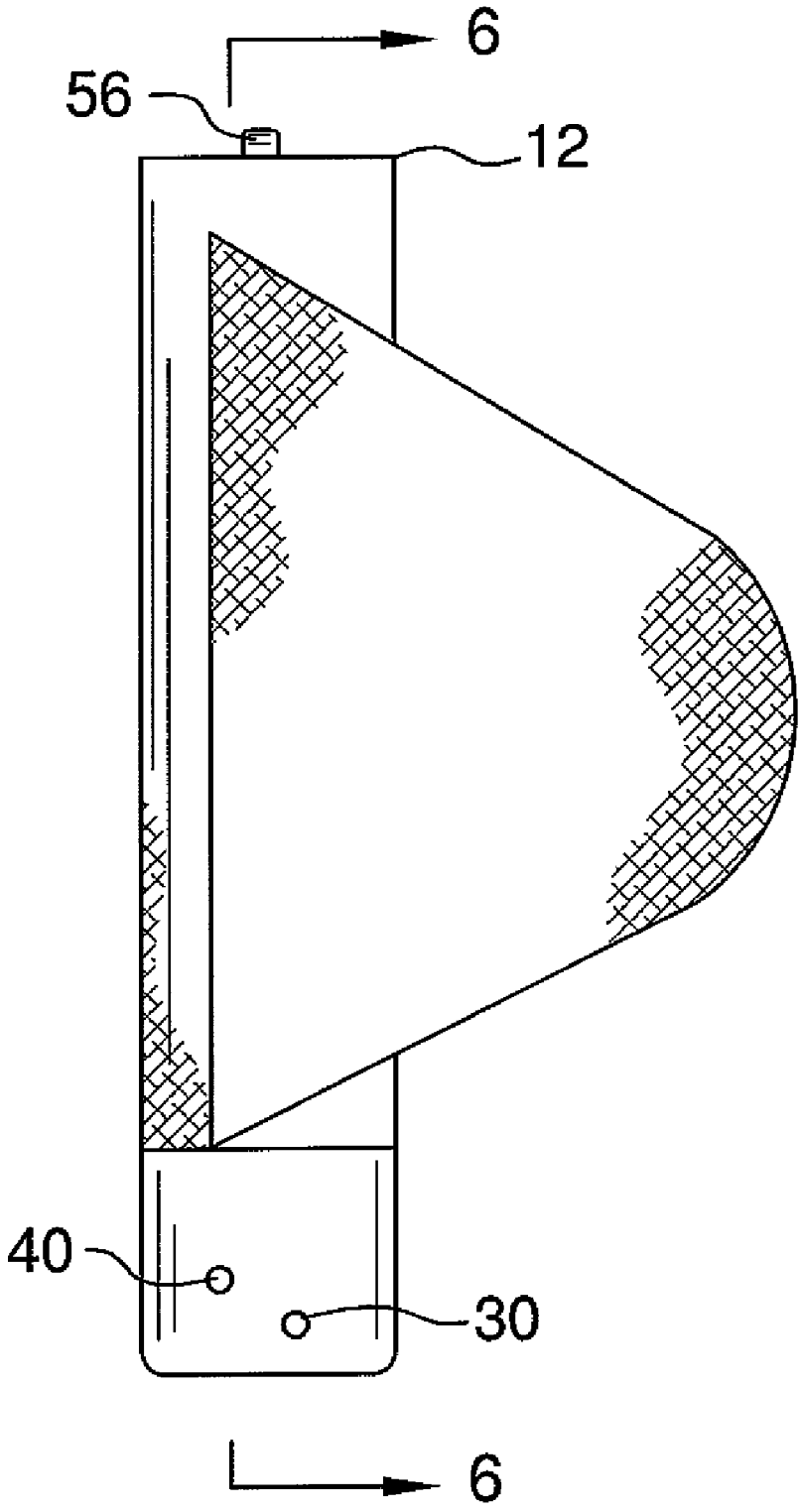
FIG. 2 is a side view of the present invention.
Figure 3:
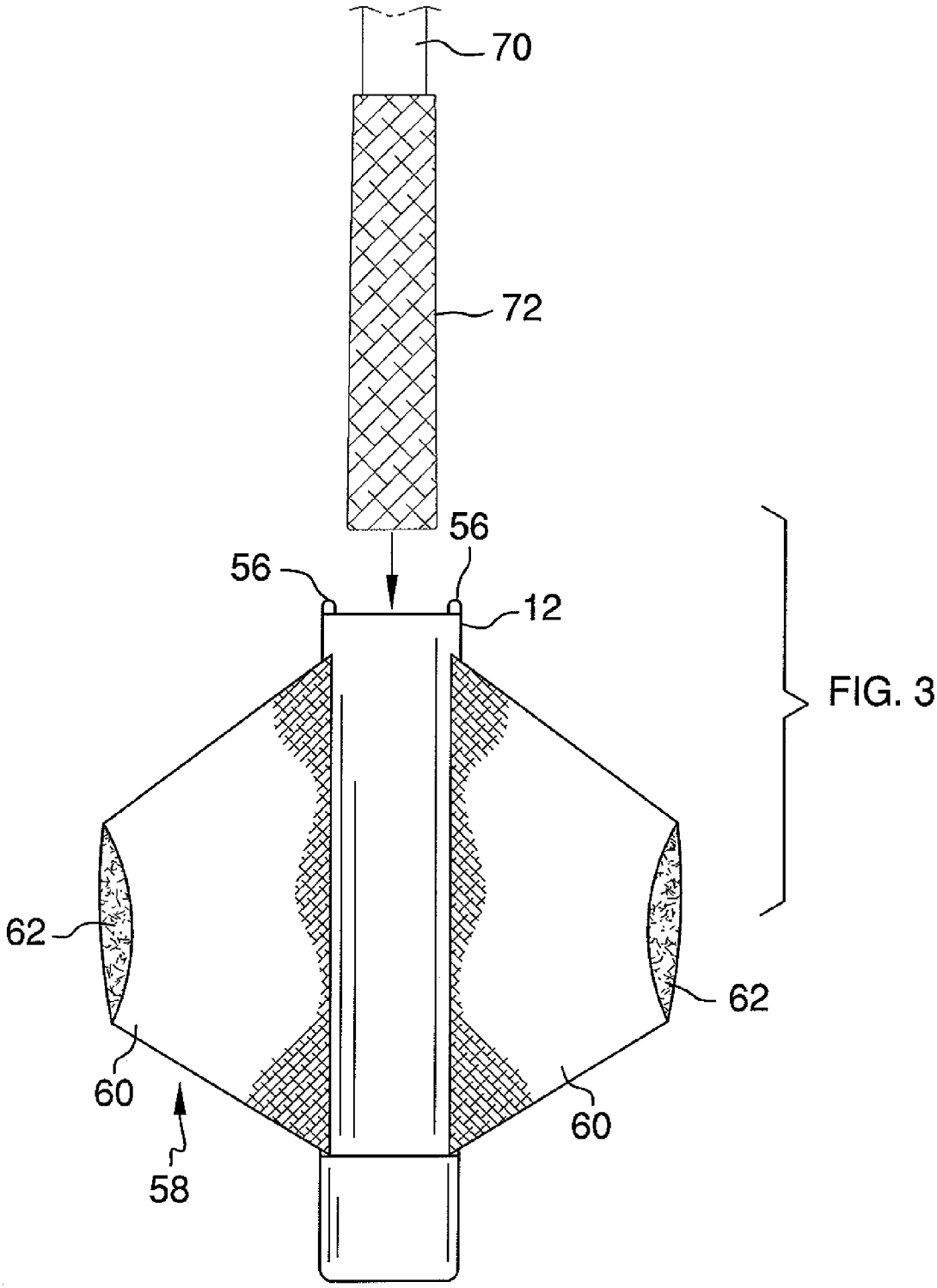
FIG. 3 is a front view of the present invention.
Figure 4:
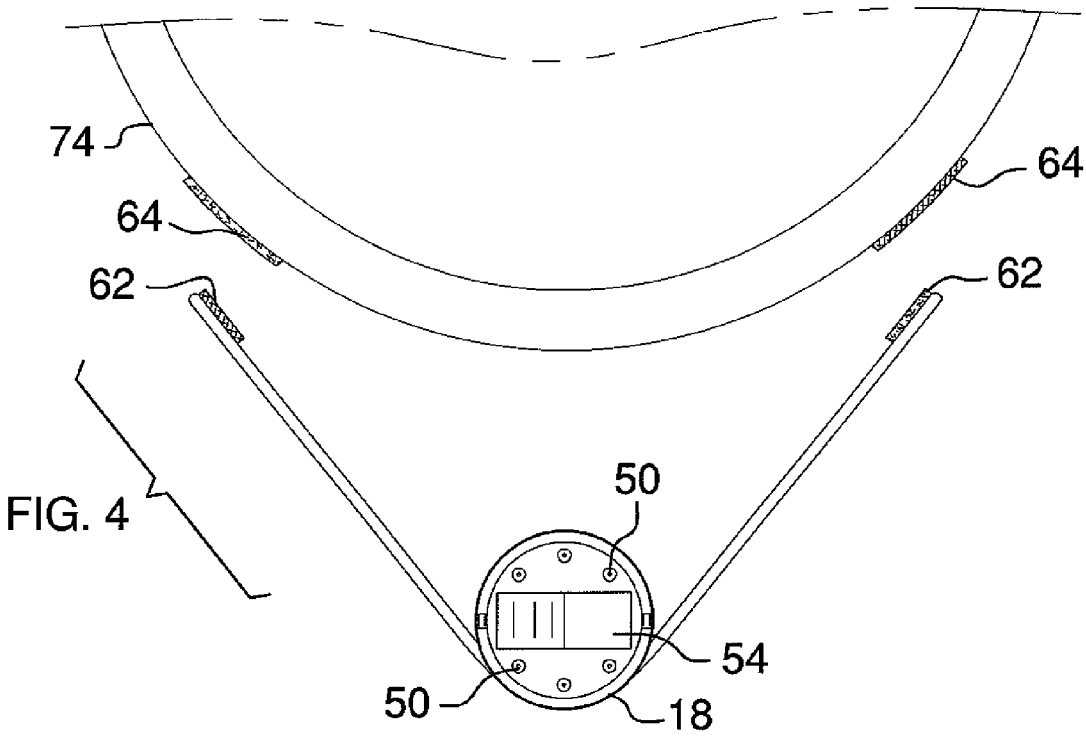
FIG. 4 is a top view of the present invention.
Figure 5:
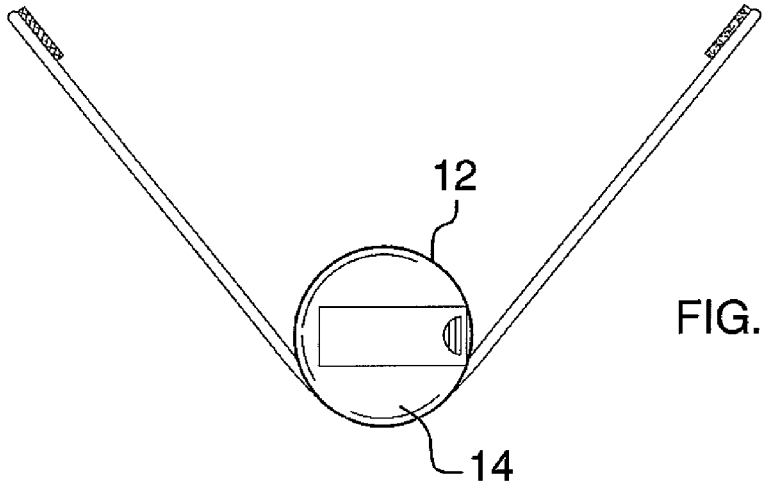
FIG. 5 is a bottom view of the present invention.

With reference now to the drawings, and in particular to FIGS. 1 through 8 thereof, a new golf club warming device embodying the principles and concepts of the present invention and generally designated by the reference numeral 10 will be described.

As best illustrated in FIGS. 1 through 8, the golf club grip warning and drying apparatus 10 and method generally includes providing a housing 12 that has a bottom wall 14 and a peripheral wall 16 that is attached to and extends upwardly from the bottom wall 14. The peripheral wall 16 has an upper edge 18 defining an access opening 20 extending into the housing 12.

Figure 6:
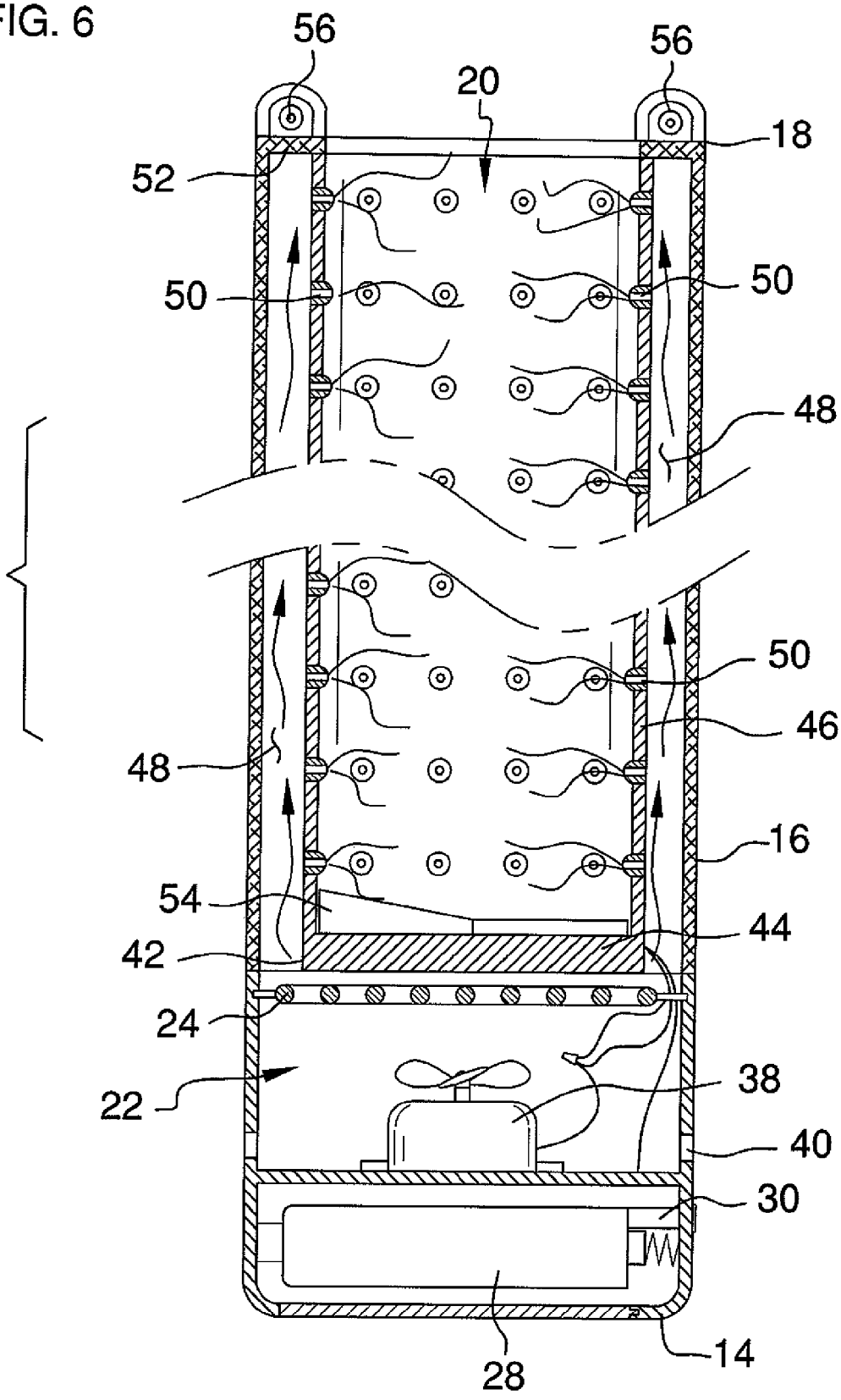
FIG. 6 is a cross-sectional view taken along line 6-6 of FIG. 2 of the present invention.
Figure 7:
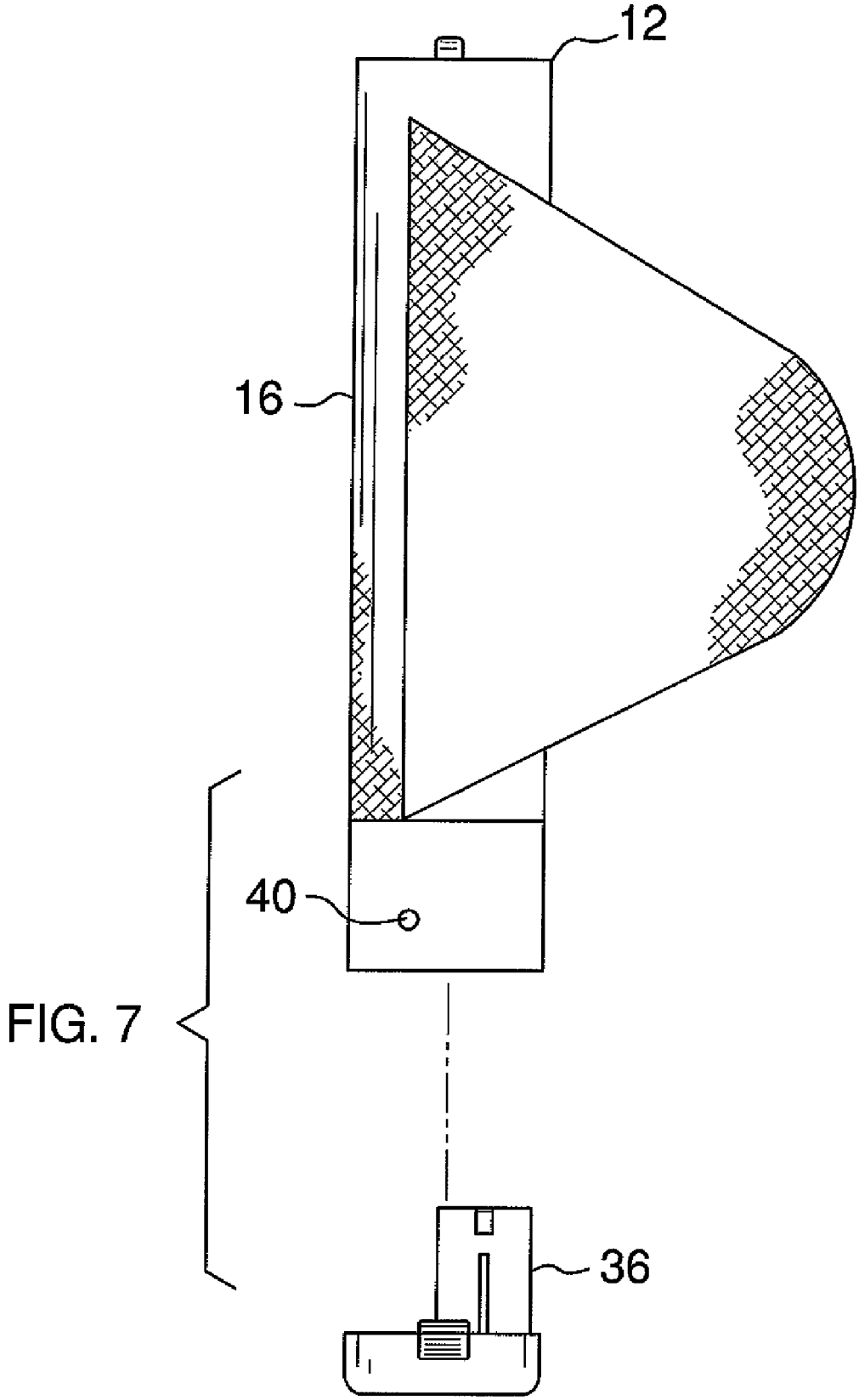
FIG. 7 is a side view of a second embodiment of the present invention.
Figure 8:
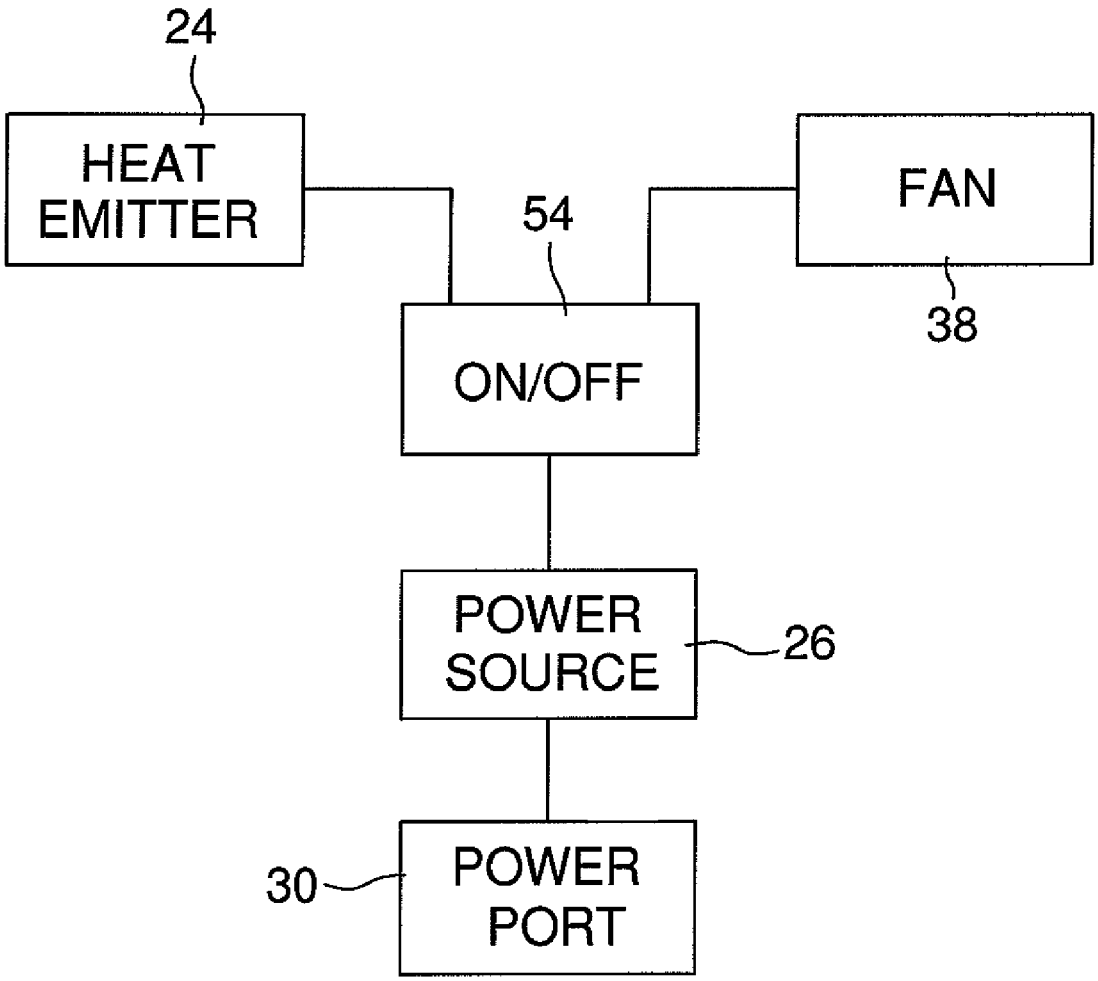
FIG. 8 is a schematic view of the present invention.

A heating assembly 22 is positioned in the housing 12. The heating assembly 22 provides warm air for an interior of the housing 12 when the heating assembly 22 is turned on. The heating assembly 22 includes a heat emitter 24 that is mounted in the housing 12 and is positioned nearer to the bottom wall 14 than the upper edge 18. The heat emitter 24 may include heating coils. A power source 26 is electrically coupled to the heat emitter 24. The power source 26 may include a removable battery 28 as shown in FIG. 6 and may also include a power port 30 extending through the peripheral wall 16 and electrically coupled to an external battery 32. This would allow a person to use a self contained battery 28 or a larger battery 32 positionable on a golf cart 34. Alternatively, as shown in FIG. 7, a rechargeable battery 36 may be used that can be removed for recharging as needed.

The heating assembly 22 further includes a fan 38 that is mounted in the housing 12 and is positioned between the heat emitter 24 and the bottom wall 14. The fan 38 directs air through the heat emitter 24 and toward the access opening 20. An air inlet 40 extends through the peripheral wall 16 between the fan 38 and the heat emitter 24. A sleeve 42 is mounted within the housing 12 and includes a lower wall 44 and a perimeter wall 46 that is attached to and extends upwardly from the lower wall 44. An air flow space 48 is defined between the perimeter wall 46 and the peripheral wall 16. The perimeter wall 46 has a plurality of apertures 50 therein to receive air heated by the heat emitter 24. The lower wall 44 may also have apertures 50 therein. An upper wall 52 extends between the sleeve 42 and the upper edge 18 to close the air flow space off 48 from the access opening 20 to force the air from the fan 38 through the apertures 50.

A power actuator 54 is electrically coupled to the heating assembly 22 to selectively turn the heating assembly 22 on or off. The power actuator 54 may be mounted on the lower wall 44 so that it may be actuated by a golf club 70 extended into the sleeve 42. The power actuator 54 may be biased into a normally off position so that the power actuator 54 is returned to the off position when the golf club 70 is removed from the sleeve 42.

At least one air outlet 56 is fluidly coupled to the air flow space 48 and is directed outwardly of the upper edge 18. The at least one air outlet 56 is angled with respect to a longitudinal axis of the housing 12 extending through the bottom wall 14 and outwardly of the access opening 20. The at least one air outlet 56 may include a pair of outlets 56 oriented perpendicular to the longitudinal axis. Warm air flowing outwardly of the air outlet(s) 56 may be used to warm a golfer's hands.

A securing assembly 58 is attached to the housing 12. The securing assembly 58 is used to releasable secure the housing 12 to an outer wall 74 of a golf bag 76. The securing assembly 58 includes a pair of flaps 60 attached to the housing 12 and extending outwardly from the housing 12 in opposite directions with respect to each other. Hook and loop fasteners 62 attached to the securing assembly 58 are attached to counterpart hook and loop fasteners 64 on the golf bag 76.

In use, a golf club grip 72 attached to a golf club 70 is extended into the housing 12 to heat the golf club grip 72 with the heating assembly 22. This may also be used drying a golf club grip 72 if it becomes wet. If a player's hands are to be warmed, the air outlet 56 is used for this purpose.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of drying and warming a golf club, said method comprising the steps of:

providing a golf bag including an outer wall;

providing a housing having a bottom wall and a peripheral wall being attached to and extending upwardly from said bottom wall, said peripheral wall having an upper edge defining an access opening extending into said housing;

providing a heating assembly positioned in said housing, said heating assembly providing warm air for an interior of said housing when said heating assembly is turned on;

providing a securing assembly attached to said housing, said securing member assembly including a pair of flaps attached to said housing extending away from said housing in opposite directions from each other, hook and loop fasteners attached to said flaps and to said golf bag to allow securing of said flaps to said golf bag;

securing said housing to said golf bag with said securing assembly;

providing a golf club grip, said golf club grip being mounted on a golf club; and extending said golf club grip into said housing and heating said golf club grip with said heating assembly.

2. The method according to claim 1, wherein the step of providing said heating assembly further includes providing:

a heat emitter being mounted in said housing and positioned nearer to said bottom wall than said upper edge;

a power source being electrically coupled to said heat emitter; and a fan being mounted in said housing and positioned between said heat emitter and said bottom wall, said fan directing air through said heat emitter and toward said access opening.

3. The method according to claim 2, wherein the step of providing said heating assembly further includes providing a single sleeve being mounted within said housing, said sleeve including a lower wall and a perimeter wall being attached to and extending upwardly from said lower wall, an air flow space being defined between said perimeter wall and said peripheral wall, said perimeter wall having a plurality of apertures therein to receive air heated by said heat emitter.

4. A method of drying and warming a golf club, said method comprising the steps of:

providing a golf bag including an outer wall;

providing a housing having a bottom wall and a peripheral wall being attached to and extending upwardly from said bottom wall, said peripheral wall having an upper edge defining an access opening extending into said housing;

providing a heating assembly positioned in said housing, said heating assembly providing warm air for an interior of said housing when said heating assembly is turned on, said heating assembly including;

a heat emitter being mounted in said housing and positioned nearer to said bottom wall than said upper edge;

a power source being electrically coupled to said heat emitter;

a fan being mounted in said housing and positioned between said heat emitter and said bottom wall, said fan directing air through said heat emitter and toward said access opening;

a single sleeve being mounted within said housing, said sleeve including a lower wall and a perimeter wall being attached to and extending upwardly from said lower wall, an air flow space being defined between said perimeter wall and said peripheral wall, said perimeter wall having a plurality of apertures therein to receive air heated by said heat emitter;

at least one air outlet being fluidly coupled to said air flow space and being directed outwardly of said upper edge, said at least one air outlet being angled with respect to a longitudinal axis of said housing extending through said bottom wall and outwardly of said access opening;

providing a securing assembly attached to said housing, said securing member assembly including a pair of flaps attached to said housing and extending away from said housing in opposite directions from each other, hook and loop fasteners attached to said flaps and to said golf bag to allow securing of said flaps to said golf bag;

securing said housing to said golf bag with said securing assembly;

providing a golf club grip, said golf club grip being mounted on a golf club; and extending said golf club grip into said housing and heating said golf club grip with said heating assembly.

5. A golf club warming apparatus for being removably mounted on a golf bag and to removably receive golf club grip, said apparatus comprising:

a golf bag a housing having a bottom wall and a peripheral wall being attached to and extending upwardly from said bottom wall, said peripheral wall having an upper edge defining an access opening extending into said housing;

a heating assembly positioned in said housing, said heating assembly providing warm air for an interior of said housing when said heating assembly is turned on;

a securing assembly attached to said housing, said securing assembly being configured to releasably secure said housing to said golf bag, said securing member assembly including a pair of flaps attached to said housing and extending away from said housing in opposite directions from each other, hook and loop fasteners attached to said flaps and to said golf bag to allow securing of said flaps to said golf bag; and wherein the golf club grip is removably extendable into said housing and heated by said heating assembly.

6. The apparatus according to claim 5, wherein said heating assembly includes:

a heat emitter being mounted in said housing and positioned nearer to said bottom wall than said upper edge;

a power source being electrically coupled to said heat emitter;

a fan being mounted in said housing and positioned between said heat emitter and said bottom wall, said fan directing air through said heat emitter and toward said access opening.

7. The apparatus according to claim 6, wherein said heating assembly further includes a single sleeve being mounted within said housing, said sleeve including a lower wall and a perimeter wall being attached to and extending upwardly from said lower wall, an air flow space being defined between said perimeter wall and said peripheral wall, said perimeter wall having a plurality of apertures therein to receive air heated by said heat emitter.

8. The apparatus according to claim 7, wherein said heating assembly further includes at least one air outlet being fluidly coupled to said air flow space and being directed outwardly of said upper edge, said at least one air outlet being angled with respect to a longitudinal axis of said housing extending through said bottom wall and outwardly of said access opening.

* * * * *